US005097515A

United States Patent [19]

Baba

[11] Patent Number: 5,097,515

[45] Date of Patent: Mar. 17, 1992

[54] ELECTRET CONDENSER MICROPHONE

[75] Inventor: Hiroyuki Baba, Kawasaki, Japan

[73] Assignee: Matsushita Electric Industrial Co., Ltd., Osaka, Japan

[21] Appl. No.: 428,535

[22] Filed: Oct. 30, 1989

[30] Foreign Application Priority Data

Nov. 30, 1988 [JP] Japan ..... 63-302915

[51] Int. Cl.[5] ..... H04R 25/00; H04R 3/00

[52] U.S. Cl. ..... 381/191; 381/111; 381/150; 381/168; 381/176

[58] Field of Search ..... 381/111, 113, 150, 154, 381/155, 158, 168, 171, 173, 174, 179, 180, 191, 192

[56] References Cited

U.S. PATENT DOCUMENTS 3,894,199 7/1975 Tamura et al. ..... 381/191

4,730,283 3/1988 Carlson et al. ..... 381/191

FOREIGN PATENT DOCUMENTS 0007300 1/1987 Japan ..... 381/111

*Primary Examiner*—Jin F. Ng

*Assistant Examiner*—William Cumming

*Attorney, Agent, or Firm*—Pollock, Vande Sande & Priddy

[57] ABSTRACT

An electret condenser microphone includes a cup-shaped metallic case having an apertured end wall, a tubular metal ring received in the metallic case, a vibratory diaphragm having on its one surface a deposited metal film and bonded to an end face of the tubular metal ring in confronting relation to the end wall with an air gap defined therebetween, and a condenser composed of a movable electrode and a fixed counter electrode, the fixed counter electrode comprising at least a part of the end wall of the metallic case while the movable electrode comprises the vibratory diaphragm. Partly because the end wall of the metallic case serves as the fixed electrode, and partly because the vibratory diaphragm is bonded to the end face of the metal ring, the number of the components of the microphone is relatively small. With this small number of components, the microphone is simple in construction and can be manufactured at a low cost, and further has a relatively large rear cavity behind the vibratory diaphragm, which improves the sensitivity of the microphone.

13 Claims, 8 Drawing Sheets

ELECTRET CONDENSER MICROPHONE

BACKGROUND OF THE INVENTION

The present invention relates to electret condenser microphones for use in various audio equipments, telephones, etc.

Electret condenser microphones are of two basic types: (1) wheel electret, having a vibratory diaphragm formed of an electret; and (2) back electret, having an electret fixed by fusing, for example, to a fixed electrode.

One such prior wheel electret condenser microphone will be described below with reference to FIG. 16 of the accompanying drawings. The wheel electret condenser microphone includes a cup-shaped metallic case 1 having a top end wall 1*a* with a plurality of sound-receiving apertures 1*b*. A metal ring 2 is secured to an inner surface of the end wall 1*a* and a stretched vibratory diaphragm 3 is fixed to an end face of the metal ring 2. The vibratory diaphragm 3 has a deposited metal film 3*a* on its one surface facing the end face of the metal ring 2. The vibratory diaphragm 3 is separated by a spacer ring 4 from a fixed back plate or counter electrode 5 so that the diaphragm 3 and the counter electrode 5 form a condenser 6 whose capacity varies with the vibrations of the diaphragm. The counter electrode 5 has pressure-equalizing holes 5*a* communicating with a rear cavity 7 behind the counter electrode 5 to equalize static pressure across the diaphragm 3. The rear cavity 7 is defined by a cup-shaped insulating support 8, which fixedly supports on its open end the counter electrode 5 and electrically separates the counter electrode 5 from the metallic case 1 and the diaphragm 3. A field-effect transistor (FET) 9 used for impedance conversion is disposed in the rear cavity 7 and electrically connected with the counter electrode 5 via an input lead 9*a*. The input lead 9*a* has one end which is either held in contact with the counter electrode 5 or fixed by spot welding to the counter electrode 5. The field-effect transistor 9 has an output lead 9*b* connected by soldering to a printed-circuit board 10 on which the insulating support 8 is mounted. The printed-circuit board 10 carrying thereon the insulating support 8, the field-effect transistor 9 and the counter electrode 5 is assembled with the cup-shaped metallic case 1 by clinching an open end edge 1*c* of the metallic case 1 over and around the periphery of the printed-circuit board 10, with all the components 5, 8, 9 received in the metallic case 1.

FIG. 17 is an exploded view of the prior electret condenser microphone shown in FIG. 16, with parts shown upside down for a purpose of illustration of the manner in which the microphone is assembled. The fixed counter electrode 5, the insulating support 8, the field-effect transistor 9 (not shown in this figure as it is mounted in the insulating support 8), and the printed-circuit board 10 are assembled together into a preassembled built-in amplifier block. In assembly, the metal ring 2 carrying on its upper end face the diaphragm 3, the spacer ring 4, and the amplifier block having the counter electrode 5 facing downward are placed in the cup-shaped metallic case 1 successively in the order named. Then an open end edge of the metallic case 1 is bent into an inwardly curled edge 1*c* (FIG. 16) firmly clinched over and around the periphery of the printed-circuit board 10. The electret condenser microphone is thus assembled.

With this construction, when the diaphragm 3 of the electret condenser microphone is vibrated by acoustic pressures impinging thereon through the sound-receiving apertures 1*b*, the diaphragm 3 produces a capacitance change between the diaphragm 3 and the fixed counter electrode 5 of the condenser 6. Since the electrical impedance of the condenser microphone is relatively very high at audio frequencies, a direct current electric field is applied in which instance the field-effect transistor 9 is used as an impedance converter.

As described above, the fixed counter electrode 5 is structurally separated from the metallic case 1 and in order to form a condenser 6 by and between the fixed counter electrode 5 and the vibratory diaphragm 3, the spacer ring 4 must be disposed between the counter electrode 5 and the diaphragm 3. The prior electret condenser microphone thus constructed has a relatively large number of component parts, is complicated in construction, requires a time-consuming assembly and is costly to manufacture. Furthermore, with this large number of components retained in the case 1, there is provided only a small room available for the formation of the rear cavity 7.

SUMMARY OF THE INVENTION

With the foregoing drawbacks of the prior art in view, it is an object of the present invention to provide an electret condenser microphone which has a small number of structural components and is simple in construction and hence can be manufactured at a low cost.

In brief, an electret condenser microphone according to the present invention includes a condenser composed of a fixed electrode formed by at least a portion of an end wall of a cup-shaped case, and a movable electrode formed by a vibratory diaphragm secured to an end face of a tubular metal ring and having on its one surface a deposited metal film. The opposite end face of the metal ring has a stepped portion in which an input lead of a field-effect transistor is received and gripped by and between the metal ring and a printed-circuit board on which the field-effect transistor is mounted for impedance conversion.

Since the field-effect transistor is directly mounted on the printed-circuit board as a single amplifier unit or block, it is no longer necessary to assemble the field-effect transistor with a fixed counter electrode forming a part of the condenser, an insulating support, and the printed-circuit board as in the prior art electret condenser microphone. Furthermore, the input lead of the field-effect transistor can be electrically connected to the metal ring with utmost ease. With this construction, the electret condenser microphone is simple in construction, can be assembled easily and can be manufactured less costly.

More particularly, according to the present invention, there is provided an electret condenser microphone comprising a cup-shaped metallic case including an end wall having a plurality of sound-receiving apertures; a tubular metal ring received in the metallic case; a vibratory diaphragm having on its one surface a deposited metal film and bonded to an end face of the tubular metal ring, the vibratory diaphragm confronting the end wall with an air gap defined therebetween; and a condenser composed of a movable electrode and a fixed counter electrode, the fixed counter electrode comprising at least a part of the end wall of the metallic case, the movable electrode comprising the vibratory diaphragm.

The above and other objects, features and advantages of the present invention will become more apparent from the following description when making reference to the detailed description and the accompanying sheets of drawings in which preferred structural embodiments incorporating the principles of the present invention are shown by way of illustrative example.

BRIEF DESCRIPTION OF THE DRAWINGS

FIG. 7(*b*) is a front end view of FIG. 7(*a*);

FIG. 9(*b*) is a view similar to FIG. 9(*a*), but showing a modified arrangement of a cup-shaped metallic case and a tubular metal ring for preventing insulation failure;

FIG. 9(*c*) is a view similar to FIG. 9(*a*), but showing another modified arrangement of the metallic case and the tubular metal ring;

DESCRIPTION OF THE PREFERRED EMBODIMENTS

Figure 1:
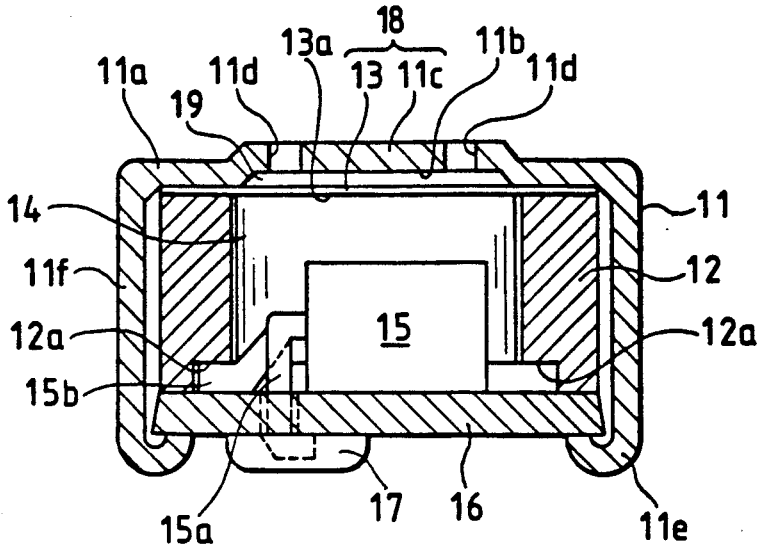
FIG. 1 is a cross-sectional view of an electret condenser microphone according to the present invention.

Referring now to the drawings, wherein like reference characters designate like or corresponding parts throughout the several views, FIG. 1 shows an electret condenser microphone according a first embodiment of the present invention.

The electret condenser microphone includes a cup-shaped metallic case 11 made of aluminum, for example, and having an end wall 11*a* closing one end of the cup-shaped metallic case 11. The end wall 11*a* has a central recess 11*b* in its inside surface, which is formed by bulging a central portion 11*c* of the end wall 11*a*. The recess 11*b* has a depth of about several tens of micrometers. The bulged central portion 11*c* of the end wall 11*a* has a plurality of sound-receiving apertures 11*d* for the passage therethrough of sound waves. A tubular metal ring 12 is disposed in the cup-shaped metallic case 11. The metal ring 12 is made of stainless steel for example and supports on its one surface a thin stretched vibratory diaphragm 13. The vibratory diaphragm 13 is formed of a synthetic resin such as fluorinated ethylene propylene and has on its one surface a deposited metal film 13*a* made of nickel, for example. A peripheral edge portion of the deposited metal film 13*a* is bonded to the end face of the metal ring 12 to assemble the vibratory diaphragm 13 with the metal ring 12 while the vibratory diaphragm 13 is kept in stretched condition. The metal ring 12 is stepped in its opposite end face so as to form an annular recess 12*a* facing an internal space of the metal ring 12, the internal space constituting a rear cavity 14 extending behind the vibratory diaphragm 13. A field-effect transistor (FET) 15 used as an impedance conversion element is mounted on a printed-circuit board 16 and received in the rear cavity 14. The FET 15 has three lead terminals, namely a source terminal (not shown), a drain terminal 15*a*, and a gate terminal 15*b*. The source terminal and the drain terminal 15*a* of FET 15 extend through holes in the printed-circuit board 16 and are soldered (as at 17) to conductors formed on the under surface of the printed-circuit board 16. The gate terminal 15*b* of FET 15 is received in the recess 12*a* of the metal ring 12 and gripped by and between the metal ring 12 and the printed-circuit board 16. The gate terminal 15*b* thus retained is electrically connected to the deposited metal film 13*a* of the vibratory diaphragm 13 via the metal ring 12. The printed-circuit board 16 is received in the cup-shaped case 11 and assembled with the latter by an inwardly curled open end edge 11*e* firmly clinched over and around a peripheral edge of the printed-circuit board 16.

Figure 16:
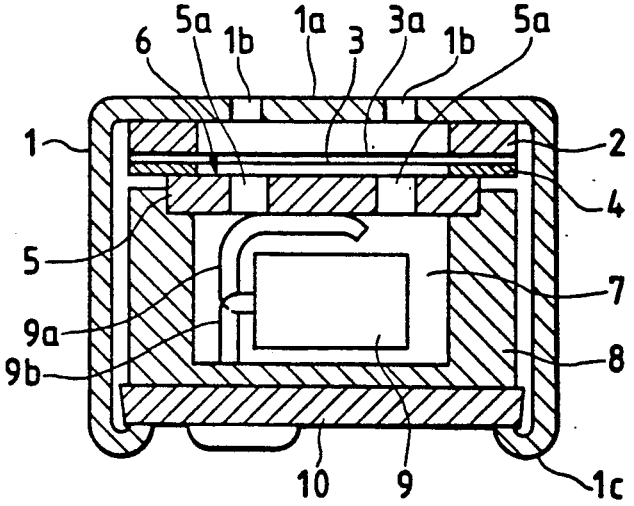
FIG. 16 PRIOR ART
FIG. 16 is a cross-sectional view of a prior electret condenser microphone.
Figure 17:
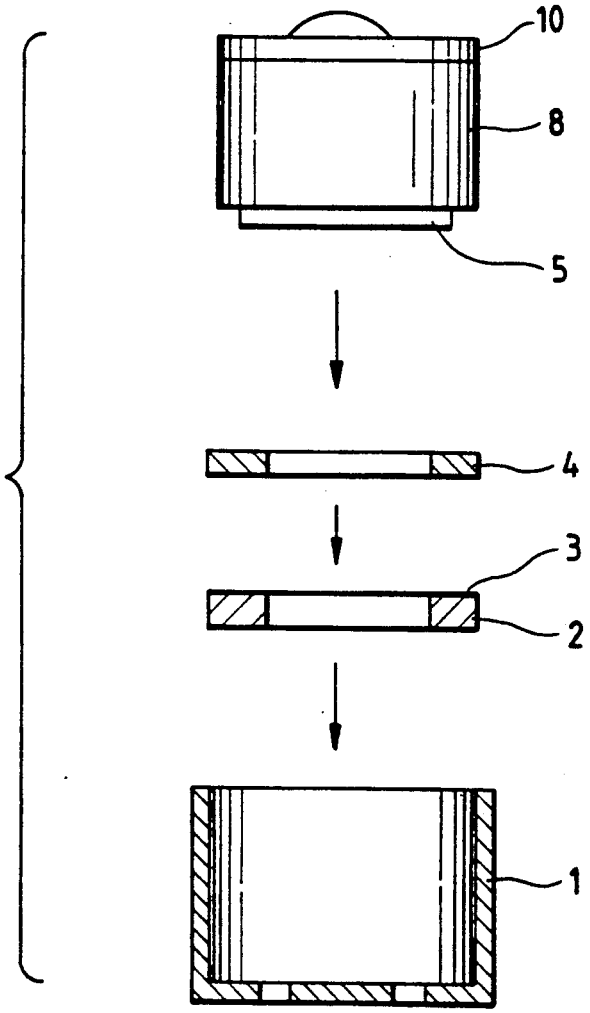
FIG. 17 PRIOR ART
FIG. 17 is an exploded view of the prior electret condenser microphone.

With this construction, the bulged central portion 11*c* of the end wall 11*a* constitutes a fixed electrode of a variable capacitor or condenser 18, a movable electrode of the condenser 18 being formed by the vibratory diaphragm 13 disposed immediately below the bulged central portion 11*c* and separated therefrom by an air gap 19 defined by the recess 11*b* in the end wall 11*a*. The arrangement of the movable and fixed electrodes 13, 11*c* of the condenser 18 is opposite to the arrangement of the movable and fixed electrodes 3, 5 of the condenser 6 of the prior electret condenser microphone shown in FIG. 16. Since the air gap 19 is communicated with the outside air through the sound-receiving apertures 11*d*, the sound-receiving apertures 11*d* may lower a shield effect against induction noises such as a hum. However, the present inventors have experimentally confirmed the fact that the noise shield characteristic of the condenser microphone never changes when the electret condenser microphone of about 10 mm diameter is provided with 6 (six) or less number of sound-receiving apertures 11*d* having a diameter of about 0.5 mm.

Figure 2:
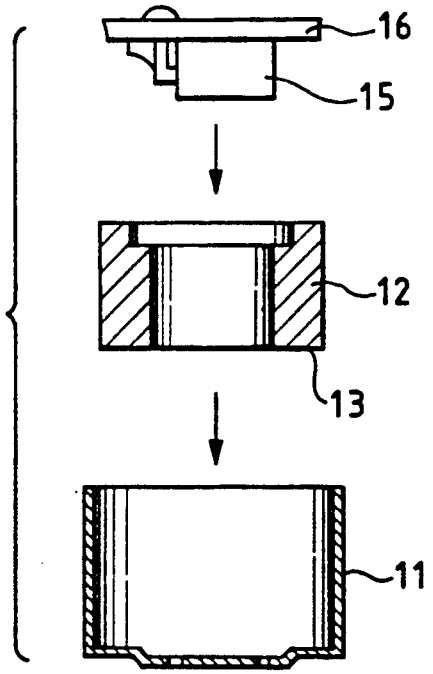
FIG. 2 is an exploded view of the electret condenser microphone shown in FIG. 1.

The electret condenser microphone of the foregoing construction is assembled as follows. After the vibratory diaphragm 13 is bonded to one end face of the tubular metal ring 12, an amplifier unit or block composed of the FET 15 mounted on the printed-circuit board 16 is secured to an opposite end face of the tubular metal ring 12, with the FET 15 received in an internal space of the metal ring 12, as shown in FIG. 2. Then, the metal ring 12 assembled with the amplifier block placed onto the end wall 11*a* of the cup-shaped metallic case 11 with the vibratory diaphragm 13 facing forward until the printed-circuit board 16 is fully received in the metallic case 11. In this instance, the gate terminal 15*b* (FIG. 1) is received in the recess 12*a* in the metal ring 12 and is firmly gripped by and between the metal ring 12 and the printed-circuit board 16. Thereafter, an open end edge of the cup-shaped metallic case 11 is bent inwardly into an inwardly curled edge 11*e* (FIG. 1) firmly clinched over and around a peripheral edge of the printed-circuit board 16. An electret condenser microphone identical to one shown in FIG. 1 is thus completed.

Figure 3:
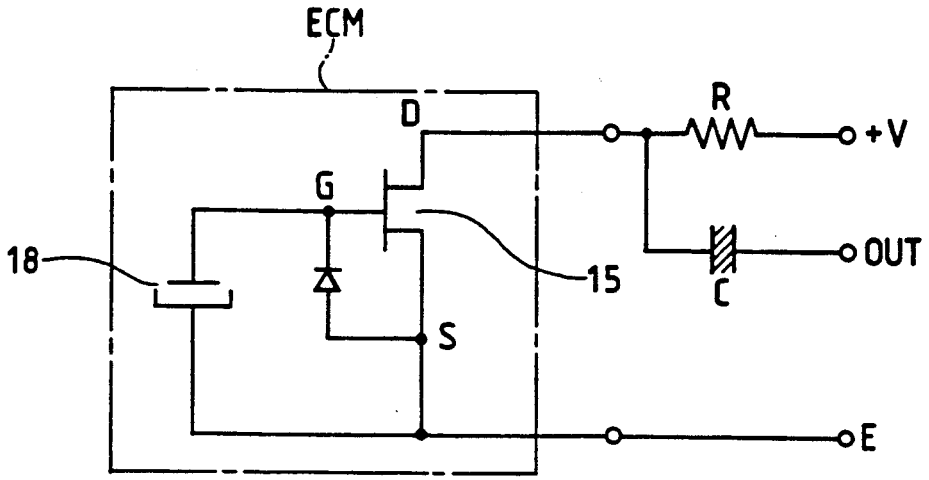
FIG. 3 is an equivalent circuit diagram of the electret condenser microphone of FIG. 1.

FIG. 3 shows an equivalent electric circuit diagram of the electret condenser microphone shown in FIG. 1. When the vibratory diaphragm 13 is displaced by sound pressures impinging thereon through the sound-receiving apertures 11*d* in the end wall 11*a* of the metallic case 11, the vibratory diaphragm 13 produces a capacitance change between the diaphragm 13 and the bulged central portion 11*c* of the end wall 11*a* that jointly form the condenser 18. The electrical output of the condenser 18 variable with the motion of the diaphragm 13 is amplified through impedance conversion by the FET 15, then the amplified output appears between an output terminal (OUT) and an earth terminal (E). In the electric circuit shown in FIG. 3, a resistor designated by R is connected at its one end to a DC power supply (+V) and at the other end to the drain terminal (D) of FET 15. Likewise, a capacitor designated by C is connected at its one end to the output terminal (OUT) and at the other end to the drain terminal (D) of FET 15.

Figure 4:
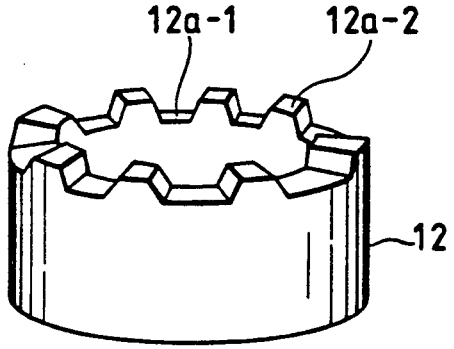
FIG. 4 is a perspective view of a tubular metal ring for use in the electret condenser microphone according to a modification, of the present invention.

FIG. 4 shows a modified form of the tubular metal ring 12 which is substantially the same as the metal ring 12 shown in FIG. 1 with the exception that one end face of the modified metal ring 12 is toothed and has a plurality of alternate radial recesses 12*a*-1 and ribs 12*a*-2 circumferentially spaced at equal intervals. When the metal ring 12 is assembled with the amplifier block, the gate terminal 15*b* (FIG. 1) of FET 15 is received in one of the recesses 12*a*-1 and is firmly gripped by and between the metal ring 12 and the printed-circuit board 16.

Figure 5:
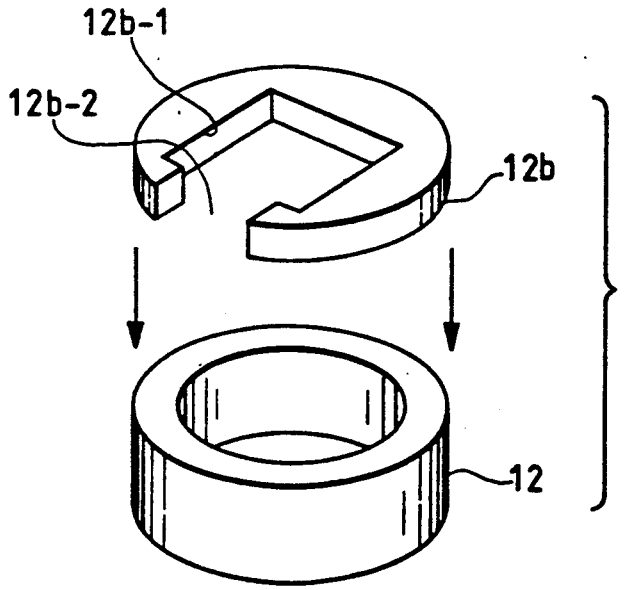
FIG. 5 is an exploded perspective view of another form of the modified tubular metal ring.

A modified tubular metal ring 12 shown in FIG. 5 is flat at its opposite end faces. The modified metal ring 12 is used in combination with a circular disc 12*b* fixedly connected to one end face of the metal ring 12. The disc 12*b* is formed of an insulating material and has a rectangular central opening 12*b*-1 and a radial groove 12*b*-2 extending from the central opening 12*b*-1 to an outer peripheral surface of the disc 12*b*. When the amplifier block is assembled with the metal ring 12 to which the disc 12*b* has been connected, the FET 15 is partly received in the central opening 12*b*-1 of the disc 12*b* and the gate terminal 15*b* of FET 15 firmly retained in the radial groove 12*b*-2 by and between the metal ring 12 and the printed-circuit board 16.

Figure 6:
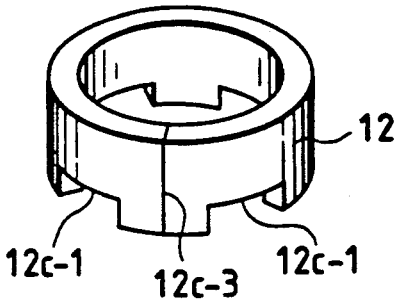
FIG. 6 is a perspective view of a modified tubular metal ring formed from a sheet metal.
Figure 7A:
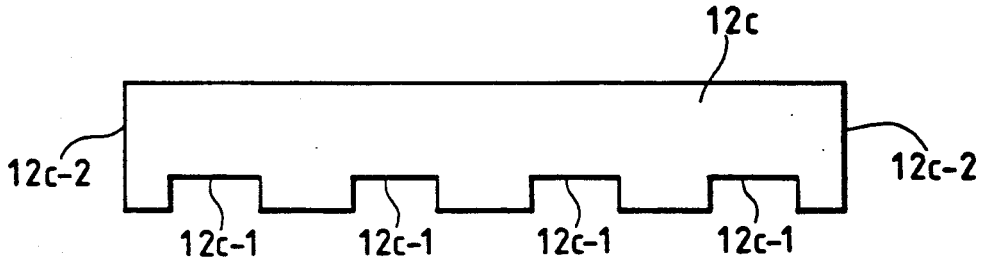
FIG. 7(*a*) is a plan view of a sheet metal from which the tubular metal ring of FIG. 6 is formed.
Figure 7B:
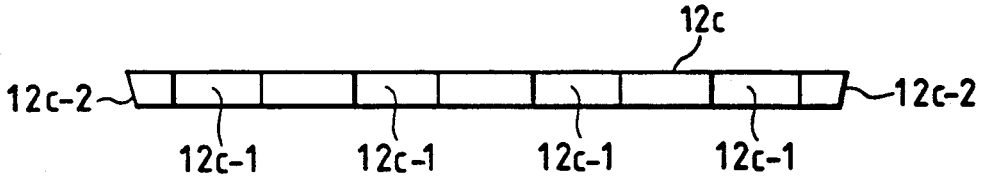
Figure 8:
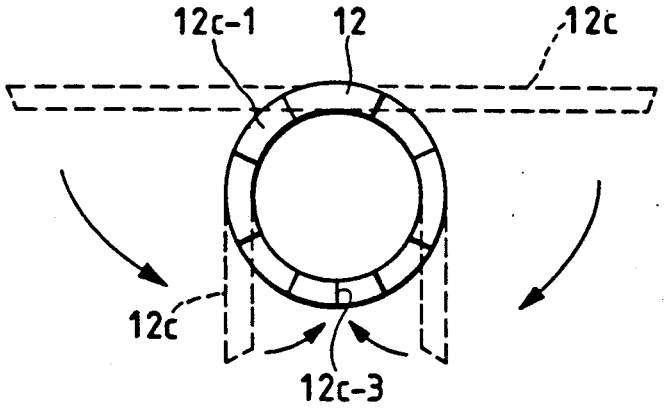
FIG. 8 is a bottom view of the tubular metal ring shown in FIG. 6, illustrating the manner in which the sheet metal shown in FIG. 7(*b*) is bent by rolling into a tubular metal ring.

FIG. 6 shows another modified form of the tubular metal ring 12 according to the present invention. The modified metal ring 12 is formed of an elongate sheet metal 12*c* shown in FIG. 7(*a*) bent or curled into a tubular ring shape. The elongate sheet metal 12*c* has a plurality of recesses 12*c*-1 formed along one longitudinal edge thereof. Opposite end edges 12*c*-2 of the sheet metal 12*c* are beveled as shown in FIG. 7(*b*) so that the beveled end edges 12*c*-2 can be met closely together at a joint area 12*c*-3 (FIG. 6) when the sheet metal 12*c* is shaped into a tubular form through a 2-stage curing operation. At a first stage of the curing, the sheet metal 12*c* is bent about a mandrel (not shown) into a U shape as indicated by broken lines in FIG. 8. Then, at a second or final stage of the curing, the U-shaped sheet metal 12*c* is further bent around the mandrel into a tubular shape. In this instance, the beveled end edges 12*c*-2 of the sheet metal 12*c* engage flatwise together at the joint area 12*c*-3 without a clearance therebetween. The tubular metal ring 12 thus obtained then supports on its flat end face a vibratory diaphragm 13. During assembly with an amplifier block, the gate terminal 15*b* (FIG. 1) of an FET 15 is received in one of the recesses 12*c*-1 and firmly retained by and between the metal ring 12 and a printed-circuit board 16 of the amplifier block. The metal ring 12 formed by curing or bending can be manufactured less costly than both of the metal ring 12 shown in FIG. 4 and the combination of the metal ring 12 and the disc 12*b* shown in FIG. 5.

Referring back to FIG. 1, the vibratory diaphragm 13 carried on one end face of the metal ring 12 is held against the inside surface of the end wall 11*a*. Since the respective outer peripheral edges of the vibratory diaphragm 13 and the metal ring 12 are located closely to an annular side wall 11*f* of the cup-shaped metallic case 11, the deposited metal film 13*a* of the vibratory diaphragm 13 or the metal ring 12 may engage an annular side wall 11*f* of the metallic case 11, causing a short or insulation failure. In order to avoid shorting, there is provided a sloped annular surface 11*g* (FIG. 9) at an inside corner defined by and between the end wall 11*a* and the side wall 11*f* of the metallic case 11. When the metal ring 12 as it is inserted into the metallic case 11 is displaced off center relative to the metallic case 11, the outer peripheral edge of the vibratory diaphragm 13 engages the sloped surface 11*g* of the metallic case 11 whereupon the vibratory diaphragm 13 and the metal ring 12 are caused by the sloped surface 11*g* to move back toward the central axis of the metallic case 11. With the sloped surface 11*g* thus provided, the deposited metal film 13*a* and the metal ring 12 are held out of contact with the side wall 11*f* of the metallic case 11 and hence an objectionable shorting or insulation failure can be avoided.

Figure 9A:
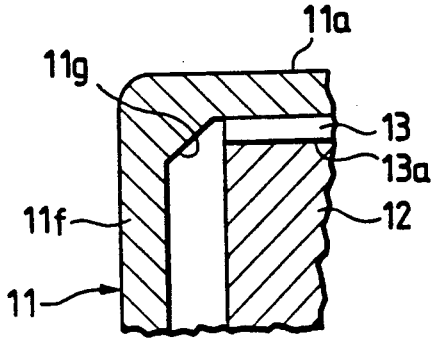
FIG. 9(*a*) is an enlarged cross-sectional view of a part of the electret condenser microphone shown in FIG. 1.
Figure 9B:
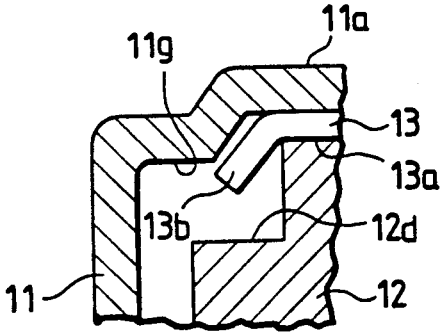
Figure 9C:
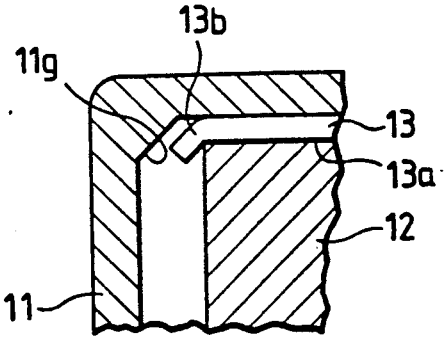

FIG. 9(*b*) shows a modified arrangement for insulation failure protection, which includes an annular step 12*d* formed at an upper peripheral edge of the metal ring 12. With the annular step 12*d* thus provided, the diameter of the vibratory diaphragm 13 exceeds the outside diameter of the stepped upper peripheral edge of the metal ring 12 and hence an outer peripheral edge portion 13*b* of the vibratory diaphragm 13 projects radially outwardly from the stepped upper peripheral edge of the metal ring 12. When the metal ring 12 is inserted into the metallic case 11, the outer peripheral edge portion 13*b* of the vibratory diaphragm 13 engages a sloped annular surface 11*g* of the metallic case 11, then is caused to bend downwardly toward the annular step 12*d*. The outer peripheral edge portion 13*b* thus bent acts as an insulator between the deposited metal film 13*a* and the metallic case 11 and also between the metal ring 12 and the metallic case 11.

Another modified form of the insulation failure protecting arrangement shown in FIG. 9(*c*) includes a vibratory diaphragm 13 having a diameter larger than the outside diameter of a metal ring 12. With this difference in diameter, an outer peripheral edge portion 13*b* of the vibratory diaphragm 13 projects outwardly from the outer periphery of the metal ring 12. The outer peripheral edge portion 13*b* is bent toward the metal ring 12 when it engages the sloped annular surface 11*g* of the metallic case 11. The deposited metal film 13*a* of the vibratory diaphragm 13 and the metal ring 12 are held out of contact with the metallic case 11 by means of an insulating member which is composed of the bent outer peripheral edge portion 13*b* of the vibratory diaphragm 13.

Figure 10:
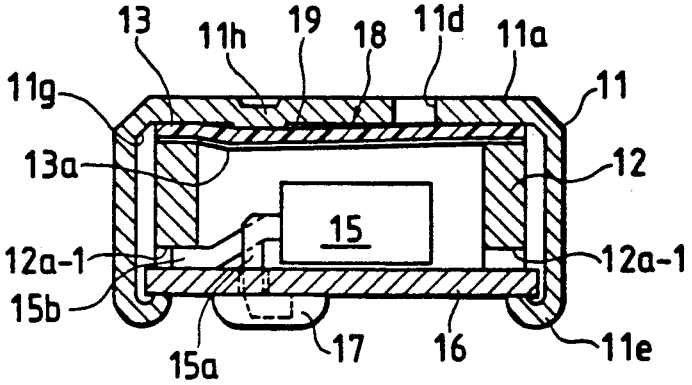
FIG. 10 is a cross-sectional view of an electret condenser microphone according to another embodiment of the present invention.
Figure 11:
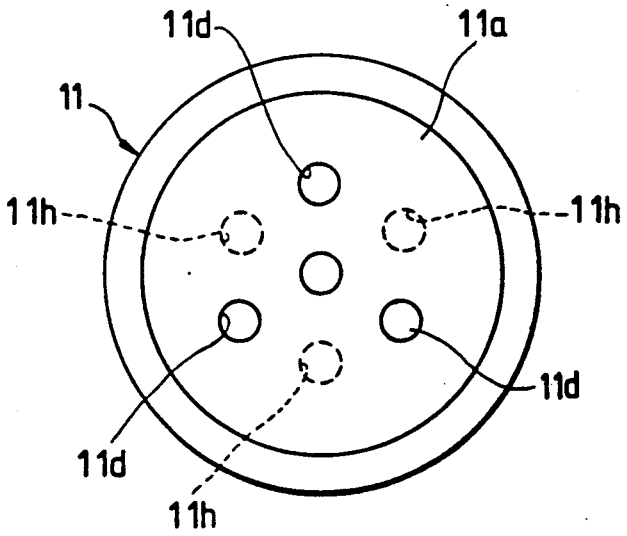
FIG. 11 is a plan view of FIG. 10.

FIG. 10 shows a modified electret condenser microphone according to the present invention. The modified electret condenser microphone is similar to the electret condenser microphone shown in FIG. 1 but differs therefrom in that the end wall 11*a* of a cup-shaped metallic case 11 has a plurality of projections (three in the illustrated embodiment as shown in FIG. 11) 11*h* on its inside surface. The projections 11*h* have a height of about 40 micrometers to 60 micrometers and urge portions of the vibratory diaphragm 13 downwardly away from the end wall 11*a* so as to provide an air gap 19 between the end wall 11*a* and the vibratory diaphragm 13. The end wall 11*a* and the vibratory diaphragm 13 thus separated by the air gap 19 jointly form a condenser or capacitor 18 whose capacitance is variable with the motion of the vibratory diaphragm 13. Stated more specifically, the cup-shaped metallic case 11 is made of aluminum, for example, and has a plurality (four in the illustrated embodiment) of sound-receiving apertures 11*d* formed in the end wall 11*a* in staggered relation to the projections 11*h*. The projections 11*h* are formed by inwardly swelling portions of the end wall 11*a* by means of a tool such as a punch. The projections 11*h* are disposed in a same circle having a center aligned with the center of the end wall 11*a* and they are circumferentially spaced at equal angular intervals. A tubular metal ring 12 made for example of stainless steel is disposed in the metallic case 11 and carries on its one end face the vibratory diaphragm 13. The vibratory diaphragm 13 is formed of a fluorine resin and has on its one surface a deposited metal film 13*a* made of nickel. The vibratory diaphragm 13 is bonded to the end surface of the metal ring 12 with the deposited metal film 13*a* interposed therebetween. An impedance conversion element comprised of a field-effect transistor 15 is mounted on a printed-circuit board 16 and has a drain terminal, not shown, and a source terminal 15*a* extending through holes in the printed-circuit board 16 and soldered as at 17 to conductors formed on the under surface of the printed-circuit board 16. The field-effect transistor 15 further has a gate terminal 15*b* received in one of a plurality of circumferentially spaced recesses 12*a*-1 formed in an opposite end face of the metal ring 12. The gate terminal 15*b* thus received in the recess 12*a*-1 is firmly gripped by and between the metal ring 12 and the printed-circuit board 16. The printed-circuit board 16 is clinched with an inwardly curled open end edge 11*e* of the cup-shaped metallic case 11, with the field-effect transistor 15 disposed within an internal space of the metal ring 12.

In assembly, the vibratory diaphragm 13 is bonded to one end face of the metal ring 12, then an amplifier unit or block composed of the field-effect transistor 15 mounted on the printed-circuit board 16 is secured to the opposite end face of the metal ring 12. In this instance, the gate terminal 15*b* of the field-effect transistor 15 is firmly retained in the recess 12*a*-1 by and between the ring 12 and the printed-circuit board 16. The metal ring 12 assembled with the amplifier block is inserted into the metallic case 11 with the vibratory diaphragm 13 facing forward. During that time, a sloped annular surface 11*g* of the metallic case 11 centers the metal ring 12 upon engagement with an outer peripheral edge of the vibratory diaphragm 13. Then, an open end edge of the cup-shaped metallic case 11 is bent into an inwardly curled edge 11*e* firmly clinched over and around the peripheral edge portion of the printed-circuit board 16, thereby assembling the electret condenser microphone shown in FIG. 10. In this assembled condition, the projections 11*h* on the end wall 11*a* urge portions of the vibratory diaphragm 13 away from the end wall 11*a* so as to provide the air gap 19 between the end wall 11*a* and the vibratory diaphragm 13 that constitute fixed and movable electrodes of the variable condenser 18.

Figure 12:
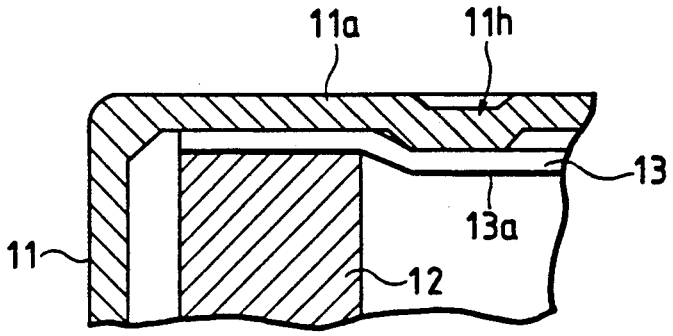
FIG. 12 is an enlarged cross-sectional view of a part of the electret condenser microphone shown in FIG. 10.

FIG. 12 shows a portion of a modified electret condenser microphone which is substantially the same as the one shown in FIG. 10 except the positions of the projections 11*h*. The projections 11*h* are disposed on a same circle whose center is aligned with the center of the end wall 11*a* of the cup-shaped metallic case 11. This circle has a diameter such that the projections 11*h* are located closely to the inner peripheral edge of the metal ring 12. The projections 11*h* thus arranged serve as positioning means for centering the metal ring 12 with respect to the central axis of the metallic case 11. With the positioning means thus provided, the deposited metal film 13*a* of the vibratory diaphragm 13 and the metal ring 12 is held out of contact with the metallic case 11.

Figure 13:
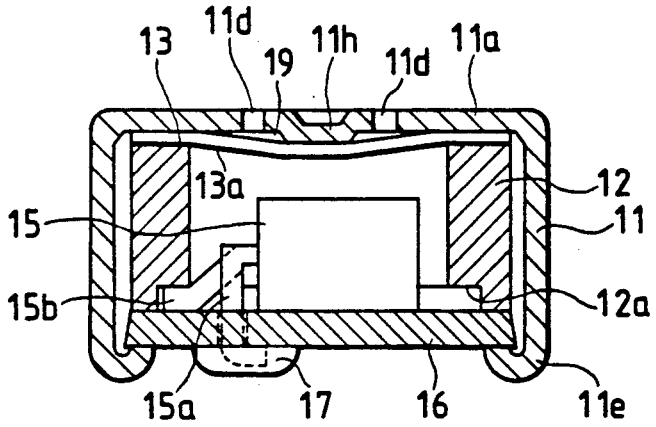
FIG. 13 is a cross-sectional view of an electret condenser microphone according a further embodiment of the present invention.

Another modified electret condenser microphone shown in FIG. 13 is substantially identical to the one shown in FIG. 10 with the exception that the end wall 11*a* of the cup-shaped metallic case 11 has only one projection 11*h* on its inside surface. The projection 11*h* is located at the center of the end wall 11*a* and urges a central portion of the vibratory diaphragm 13 away from the end wall 11*a* so as to define an air gap 19 between the end wall 11*a* and the vibratory diaphragm 13.

Figure 14:
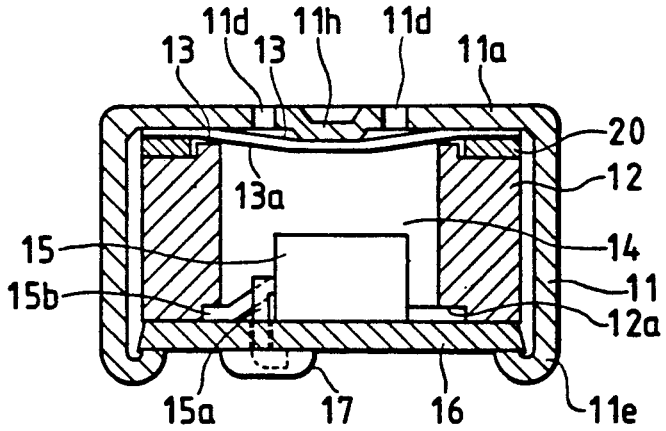
FIG. 14 is a view similar to FIG. 3, but showing an electret condenser microphone according to still another embodiment.

FIG. 14 shows a modified form of the electret condenser microphone according to the embodiment shown in FIG. 13. The modified electret condenser microphone includes a ring plate 20 bonded at its one side to an outer peripheral edge of the vibratory diaphragm 13 and secured at its opposite side to a recessed end surface of the tubular metal ring 12.

Figure 15:
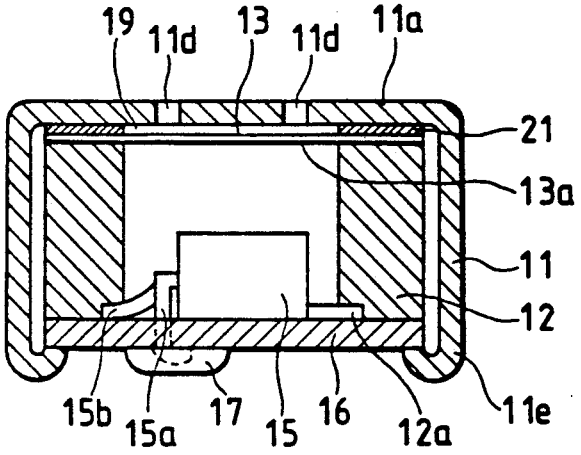
FIG. 15 is a cross-sectional view of an electret condenser microphone according to another embodiment of the present invention.

A still further modified electret condenser microphone shown in FIG. 15 includes a spacer ring 21 disposed between an end wall 11*a* of a cup-shaped metallic case 11 and the vibratory diaphragm 13 bonded to one end face of the metal ring 12, so as to provide an air gap 19 between the end wall 11*a* and the vibratory diaphragm 13 that constitute fixed and movable electrodes of a variable condenser or condenser 18. The spacer ring 21 thus provided obviates the need for the gap-forming recess 11*b* or the gap-forming projection 11*h* as required in the electret condenser microphones according to any of the foregoing embodiments.

As described above, at least a portion of the end wall 11*a* of the cup-shaped metallic case 11 constitutes a fixed electrode of a condenser 18. The use of such end wall 11*a* makes a separate fixed electrode unnecessary and hence the number of components of the electret condenser microphone is reduced. Consequently, the electret condenser microphone is simple in construction and suited for automated production, and hence can be manufactured at a low cost. Furthermore, since the fixed electrode is no longer required to be disposed in the metallic case 11, there is provided a large room available for the formation of a rear cavity 14 behind the vibratory diaphragm 13. With this large rear cavity 14, the sensitivity of the microphone is improved. Accordingly, when manufacturing an electret condenser microphone having a same sensitivity as the conventional one, a substantial reduction of the overall size of the microphone can be obtained.

Obviously various minor changes and modifications of the present invention are possible in the light of the above teaching. It is therefore to be understood that within the scope of the appended claims the invention may be practiced otherwise than as specifically described.

What is claimed is:

1. An electret condenser microphone comprising:

(a) a cup-shaped metallic case including an end wall having a plurality of sound-receiving apertures;

(b) a tubular metal ring received in said metallic case;

(c) a vibratory diaphragm having on its one surface a deposited metal film and bonded to an end face of said tubular metal ring, said vibratory diaphragm confronting said end wall with an air gap defined therebetween; and (d) a condenser composed of a movable electrode and a fixed counter electrode, said fixed counter electrode comprising at least a part of said end wall of said metallic case, said movable electrode comprising said vibratory diaphragm.

2. An electret condenser microphone as claimed in claim 1, wherein said end wall has a recess in its inside surface and is held in contact with said vibratory diaphragm except a portion including said recess, said recessed portion constituting said fixed counter electrode.

3. An electret condenser microphone as claimed in claim 1, wherein said end wall has a projection on its inside surface, said projection being held in pressure contact with a portion of said vibratory diaphragm to urge said vibratory diaphragm away from said end wall so as to provide said air gap between said end wall and said vibratory diaphragm.

4. An electret condenser microphone as claimed in claim 1, wherein said tubular metal ring is formed of a sheet metal bent into a tubular ring form.

5. An electret condenser microphone as claimed in claim 1, further including a printed-circuit board having an impedance conversion element mounted thereon, said printed-circuit board being received in said cup-shaped metallic case and secured to an opposite end face of said metal ring, said impedance conversion element having a terminal held in contact with said metal ring.

6. An electret condenser microphone as claimed in claim 5, wherein said impedance conversion element comprises a field-effect transistor, said field-effect transistor having a gate terminal held in contact with said metal ring.

7. An electret condenser microphone as claimed in claim 5, wherein said impedance conversion element is disposed in said cup-shaped metallic case, said cup-shaped metallic case having an inwardly curled open end edge firmly clinched over and around a peripheral edge of said printed-circuit board.

8. An electret condenser microphone as claimed in claim 5, wherein said metal ring has a recessed said opposite surface thereof, said terminal of said impedance conversion element being received in said recess and gripped by and between said metal ring and said printed-circuit board.

9. An electret condenser microphone as claimed in claim 5, further including a circular disc formed of an insulating material and secured between said opposite end face of said metal ring and said printed-circuit board, said circular disc having a central opening and a radial groove extending from said central opening to a peripheral surface of said circular disc, said terminal of said impedance conversion element being received in said radial groove and gripped by and between said metal ring and said printed-circuit board.

10. An electret condenser microphone as claimed in claim 1, wherein said cup-shaped metallic case has a sloped surface at an inside corner defined between said end wall and an annular side wall of said metallic case.

11. An electret condenser microphone as claimed in claim 1, wherein said vibratory diaphragm has a diameter larger than the outside diameter of said metal ring and includes a peripheral edge portion projecting outwardly from said metal ring and bent toward said metal ring.

12. An electret condenser microphone as claimed in claim 1, wherein said end wall has a plurality of projections on its inside surface, said projections urging portions of said vibratory diaphragm away from said end wall so as to provide said air gap between said vibratory diaphragm and said end wall, said projections constituting means of positioning said metal ring relative to said metallic case.

13. An electret condenser microphone as claimed in claim 1, further including a spacer ring disposed between said end wall of said metallic case and said vibratory diaphragm.

* * * * *